United States Patent [19]

Frumkin et al.

[11] 3,989,393

[45] Nov. 2, 1976

[54] SCRUBBING DEVICE

[75] Inventors: Mitchell J. Frumkin; Albert G. Keller, both of Chicago, Ill.

[73] Assignee: Marvin Glass & Associates, Chicago, Ill.

[22] Filed: Aug. 13, 1975

[21] Appl. No.: 604,445

[52] U.S. Cl. ..... 401/208; 401/201

[51] Int. Cl.[2] ..... A47L 13/16; A47K 7/02

[58] Field of Search ..... 401/208, 201

[56] References Cited

UNITED STATES PATENTS

| | | | |
|---|---|---|---|
| 3,143,755 | 8/1964 | Rowley | 401/201 X |
| 3,270,366 | 9/1966 | Maichen | 401/208 |
| 3,426,464 | 2/1969 | Mezey | 401/201 |

FOREIGN PATENTS OR APPLICATIONS

| | | |
|---|---|---|
| 822,837 | 11/1951 | Germany |

*Primary Examiner*—Lawrence Charles
*Attorney, Agent, or Firm*—Coffee & Sweeney

[57] ABSTRACT

A scrubbing device particularly for use by children. The scrubbing device has a frame in a shape resembling an automobile or other vehicle with four relatively soft scrubbing wheels attached thereto. A cake of soap is disposed within an interior compartment of the frame in contact with the back sides of the rear wheels of the vehicle. Rotation of the rear wheels by movement over the user's skin transfers the soap from the enclosed cake to the skin, with all four wheels providing for scrubbing action.

9 Claims, 6 Drawing Figures

Fig 1
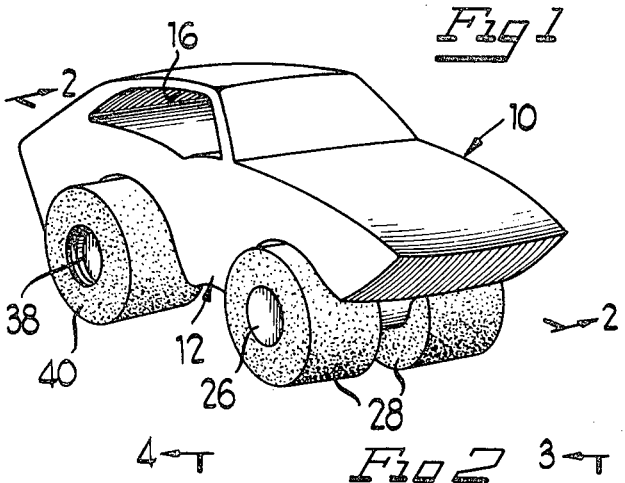
Fig 3
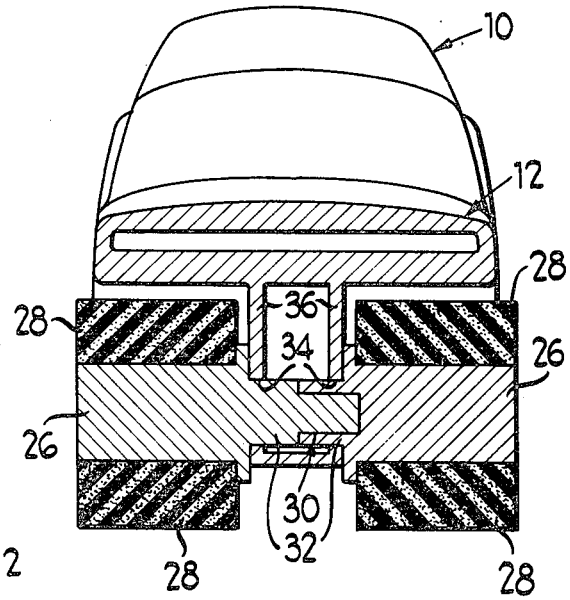
Fig 2
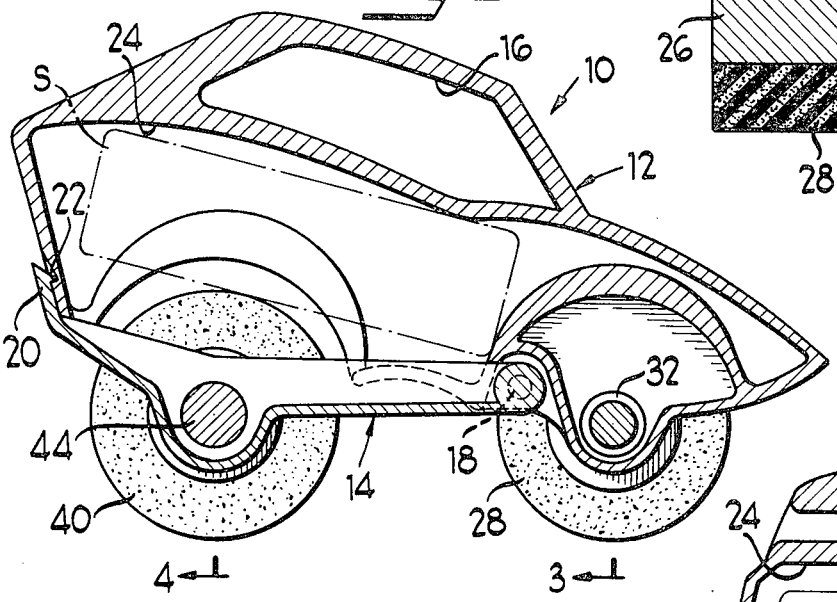
Fig 4
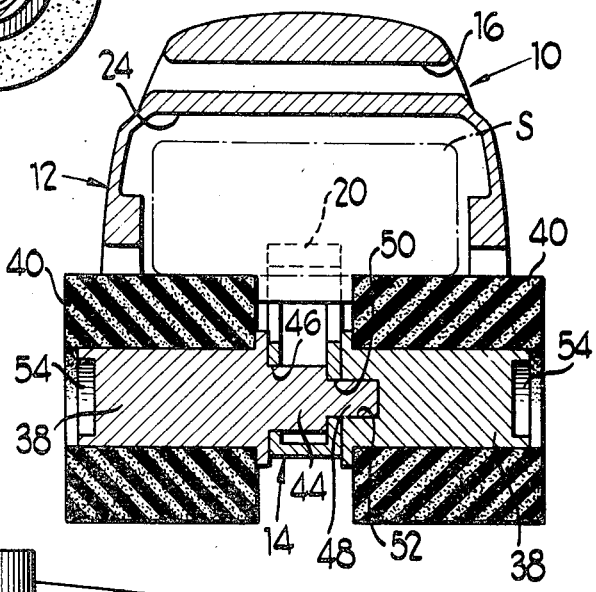
Fig 6
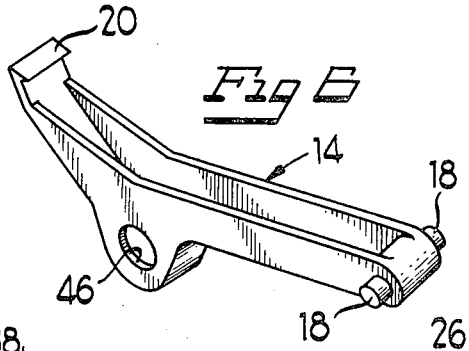
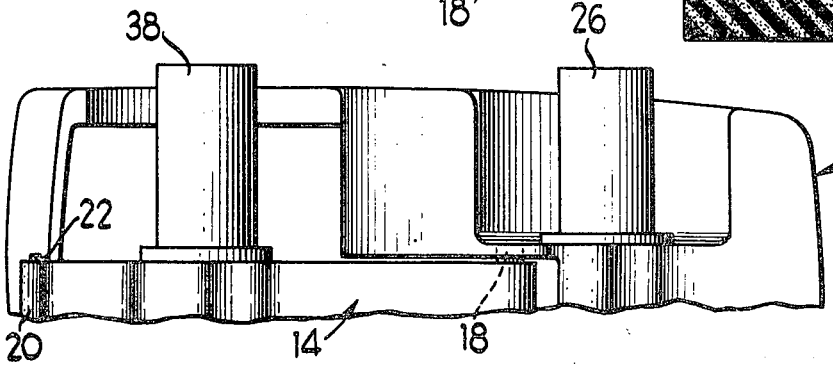
Fig 5

SCRUBBING DEVICE

SUMMARY OF THE INVENTION

This invention relates to a new and improved scrubbing device and particularly to a scrubbing device to stimulate children to wash themselves and promote body hygiene.

It is an object of the present invention, therefore, to provide a new and improved scrubbing device of the character described.

In the exemplary embodiment, the scrubbing device has a two part frame in the form of a miniature automobile. The frame includes an upper portion shaped in the form of a body of the automobile and a lower frame portion pivotally mounted to the underside of the body portion for closing an interior compartment therewithin for receiving a cake of soap. Latch means is provided between the two frame portions to gain access to the interior compartment for replacing the cake of soap. Front and rear wheels are provided for the simulated automobile in the form of rollers having outer coverings fabricated of soft porous material, such as foamed plastic or the like, for scrubbing the user's skin. The front wheels are rotatably mounted on the underside of the upper body portion of the frame. The rear wheels are mounted on the pivoted lower body portion, with the back sides of the wheels engageable with the cake of soap in the interior compartment of the frame for transferring soap from the cake to the skin.

Other objects, features and advantages of the invention will be apparent from the following detailed description taken in connection with the accompanying drawings.

DESCRIPTION OF THE DRAWINGS

FIG. 1 is a front perspective view of the scrubbing device of the present invention;

FIG. 2 is a vertical front to rear central section, on an enlarged scale, taken generally along the line 2—2 of FIG. 1;

FIG. 3 is a vertical section taken generally along the line 3—3 of FIG. 2;

FIG. 4 is a vertical section taken generally along the line 4—4 of FIG. 2;

FIG. 5 is a fragmented bottom plan view of the device, with the soft wheel coverings removed to show the hubs therefor; and FIG. 6 is a perspective view of the bottom frame portion on which the rear wheels are rotatably mounted and which provides access to the interior soap compartment.

DETAILED DESCRIPTION OF THE PREFERRED EMBODIMENT

Referring to the drawings in greater detail, the scrubbing device of the present invention, generally designated 10, is shown in perspective in FIG. 1 and, as can be seen, is in the form of a miniature automobile.

The miniature automobile, as best seen in FIG. 2, includes a two part frame having an upper portion, generally designated 12, and a lower portion, generally designated 14. The upper frame portion 12 is in the shape of a body for the automobile and includes a see-through side-to-side opening 16 representing windows for the automobile. The lower frame portion 14 is pivoted to the underside of the upper frame portion 12 by pivot pins 18 (FIG. 6) received in appropriate apertures on the underside of the upper frame portion. The lower frame portion 14 extends rearwardly from the pivot pins 18 to an upwardly extending hook 20 which snaps over a shoulder 22 at the bottom rear of the upper body portion providing a latch between the two frame parts. As seen in FIG. 2, when the body parts 12 and 14 are in their latched condition, an interior compartment 24 is provided for receiving a cake of soap S. The two part frame is fabricated of relatively rigid material, such as plastic, but the hook 22 can be moved away from the shoulder 20 to provide access to the interior compartment 24 for replacing the cake of soap S.

Referring to FIGS. 2 and 3, the miniature vehicle shaped scrubbing device includes a pair of front wheels having hub portions 26 about which are positionable cylindrical outer coverings 28 of soft porous material, such as foamed plastic or the like. The hubs 26 are secured together by a male-female connection, generally designated 30 (see FIG. 3), disposed at the inner ends of shaft portions 32. The shaft portions 32 are journalled within openings 34 in flanges 36 on the underside of the front of the upper frame portion 12. The soft front wheels are provided for scrubbing purposes as they rotate over a surface to be cleaned. Of course, a friction fit may be provided between the shaft portions 32 and the openings 34 to resist some or all of the rotation of the wheels, if so desired. The soft outer coverings 28 are removable from the hubs 26 (see FIG. 5) but are sufficiently tight about the hubs to permit a scrubbing action.

The miniature vehicle scrubbing device is provided with rear wheels somewhat similar to the front wheels and include hub portions 38 having wrapped thereabout removable cylindrical outer coverings 40 of soft porous material similar to that of the outer coverings 28. The hub portion 38 of the left hand wheel as viewed in FIG. 4 has a shaft portion 44 formed integral therewith and extending through an aperture 46 (also see FIG. 6) in the lower frame portion 14. The shaft 44 has a reduced diameter shaft extension 48 which extends through an aperture 50 in the lower frame portion 14 aligned with the aperture 46. The shaft extension 48 also is press fit within a recess 52 in the right hand hub 38 as viewed in FIG. 4 providing a male-female connection between the rear wheels for conjoint rotation thereof relative to the lower frame portion 14. As seen in FIG. 5, the soft outer coverings for the rear wheels, like the front wheels, are removable for replacement purposes but are sufficiently tight on the hub portions 38 to permit a scrubbing action. Simulated hub caps 54 (FIG. 4) are provided in the outer ends of the rear wheels.

In operation, although all four wheels of the miniature vehicle scrubbing device are provided for scrubbing purposes, it can be seen that the backsides of the rear wheels are disposed within the interior compartment 24 in engagement with the cake of soap S. As the rear wheels rotate over a person's skin or other surface to be cleaned, the rear wheels transfer soap from the cake to the skin to facilitate cleaning thereof. With the outer coverings of the wheels being made of soft porous material, water from a wash basin, bath tub or shower can be absorbed and carried with the wheels as well as against the cake of soap.

The foregoing detailed description has been given for clearness of understanding only and no unnecessary limitations should be understood therefrom as some modifications will be obvious to those skilled in the art.

We claim:

1. A scrubbing device, comprising:

a frame having an interior compartment for receiving a cake of soap;

first scrubbing roller means rotatably mounted on the frame for engaging and scrubbing a surface to be cleaned, said roller means being engageable on the back side thereof with the cake of soap in said compartment for transferring soap from the cake to said surface;

second scrubbing roller means rotatably mounted on the frame for engaging and scrubbing said surface; and access means for movably mounting said first scrubbing roller means to provide access to said interior compartment for replacing the cake of soap.

2. The scrubbing device of claim 1 wherein both of said scrubbing roller means are rotatably mounted on parallel axes and simultaneously engageable with said surface.

3. The scrubbing device of claim 2 wherein said frame is in the form of a miniature automobile and said first and second roller means are mounted thereon in position as front and rear wheel means for the automobile.

4. The scrubbing device of claim 3 wherein said access means comprises a hinged subframe portion pivotally mounted on said frame and pivotal between an open position and a closed position, with said first roller means being rotatably mounted thereon, said subframe portion including a flexible latch for releasably maintaining said subframe in its closed position.

5. The scrubbing device of claim 1 wherein at least the outer surface engaging portion of said roller means is removably mounted to a wheel hub and fabricated of soft porous material such as foamed plastic or the like.

6. A scrubbing device, comprising:

a two part frame having a first part in the shape of the body of a miniature automobile and a second lower frame part pivotally mounted to the upper body frame part on the underside thereof and movable between a closed and an open position to define a compartment therewithin for maintaining a cake of soap when in said closed position; and front and rear wheel means rotatably mounted on the two part frame for engaging and scrubbing a surface to be cleaned, at least one of said front or rear wheel means being pivotally mounted by said lower frame part so as to be engageable on the back side thereof with a cake of soap in said compartment for transferring soap from the cake to said surface, at least the outer portions of said wheel means being fabricated of relatively soft material.

7. The scrubbing device of claim 6 including latch means comprising a hook and notch between the two parts of said frame to releasably hold the lower part in the closed position and to permit access to said compartment for replacing the cake of soap when in said open position.

8. The scrubbing device of claim 6 wherein said front wheel means is rotatably mounted by a central journal on the underside of said upper body frame portion for scrubbing purposes and said rear wheel is rotatably mounted by a central journal on said frame portion for scrubbing purposes as well as engaging the cake of soap.

9. The scrubbing device of claim 6 wherein said wheel means include hub portions about which said soft material outer portions are removably mounted.

* * * * *

UNITED STATES PATENT AND TRADEMARK OFFICE

CERTIFICATE OF CORRECTION

PATENT NO. : 3,989,393

DATED : November 2, 1976

INVENTOR(S) : Mitchell J. Frumkin et al

It is certified that error appears in the above-identified patent and that said Letters Patent are hereby corrected as shown below:

Claim 8, line 4, after "wheel", insert --means--; same

Claim 8, line 5, after "said", insert --lower--.

Signed and Sealed this

First Day of February 1977

[SEAL]

*Attest:*

RUTH C. MASON
*Attesting Officer*

C. MARSHALL DANN
*Commissioner of Patents and Trademarks*